US005417365A

United States Patent [19]

Lindsay

[11] Patent Number: 5,417,365

[45] Date of Patent: May 23, 1995

[54] STRAP HANDLE AND PACKAGE CONTAINING SAME

[75] Inventor: Frank E. Lindsay, Hamilton Township, Atlantic County, N.J.

[73] Assignee: Church & Dwight Co., Inc., Princeton, N.J.

[21] Appl. No.: 179,125

[22] Filed: Jan. 10, 1994

Related U.S. Application Data

[63] Continuation-in-part of Ser. No. 24,418, Mar. 1, 1993, Pat. No. 5,277,359.

[51] Int. Cl.[6] ..... B65D 5/46

[52] U.S. Cl. ..... 229/117.22; 220/416; 220/754; 220/770; 229/117.25; 229/117.26

[58] Field of Search ..... 229/117.22, 117.23, 229/117.24, 117.25, 117.26, 225, 920; 220/416, 418, 754, 758, 770; 383/14

[56] References Cited

U.S. PATENT DOCUMENTS

| | | | |
|---|---|---|---|
| 2,289,964 | 7/1942 | Hanford | 294/27 |
| 3,620,410 | 11/1971 | Griese, Jr. | 220/94 R |
| 3,623,633 | 11/1971 | Kinn | 220/94 R |
| 3,717,277 | 2/1973 | Stengle, Jr. | 215/100 |
| 3,737,069 | 6/1973 | Owen | 220/94 R |
| 4,396,128 | 8/1983 | Larson et al. | 215/100 |
| 4,573,203 | 2/1986 | Peppiatt | 383/8 |
| 4,763,833 | 8/1988 | Stoll | 229/52 B |
| 4,986,420 | 1/1991 | Gunn et al. | 206/607 |
| 5,161,710 | 11/1992 | Chumley | 220/754 |
| 5,209,394 | 5/1993 | Griffiths et al. | 229/225 |
| 5,277,359 | 1/1994 | Lindsay | 229/117.22 |

FOREIGN PATENT DOCUMENTS

| | | | |
|---|---|---|---|
| 135156 | 12/1945 | Australia | 383/14 |

*Primary Examiner*—Gary E. Elkins
*Attorney, Agent, or Firm*—Charles B. Barris

[57] ABSTRACT

A strap handle for a package and being capable of attachment to the sidewall of the package comprises a longitudinal slit sufficiently long to divide the strap handle into a lower attachment portion which is secured to the package and an upper free ribbon portion which can be pulled away from the sides of the package and lifted over the top of the package for transport. The strap handle is a flexible sheet or film which can be glued to the package.

20 Claims, 5 Drawing Sheets

STRAP HANDLE AND PACKAGE CONTAINING SAME

This is a Continuation in-Part of U.S. Ser. No. 08/024,418, filed Mar. 1, 1993, now U.S. Pat. No. 5,277,359 issued Jan. 11, 1994.

BACKGROUND OF THE INVENTION

1. Field of the Invention

The present invention relates to a novel handle for packages. The invention is also directed to packages, in general, containing the novel handle and, more specifically, to flip-top packages containing the novel handle which can be used for transporting the package after the package has been opened. The invention is also concerned with a novel handle for packages used to store granular products.

2. Description of Prior Art

Many products are provided to consumers in granular form which includes any form having physical characteristics similar to granular materials, such as powders. Among the list of granular consumer products are many laundry detergents and dish washing detergents. Granular detergents are generally used in relatively large volumes. Due to the vast quantity of consumer products sold in granular form, there is a great demand for convenient and strong packages to house these products.

Packages for granular consumer products should have several key characteristics. The package must be able to withstand the rigors of transportation from the manufacturer to the retailer and to the ultimate place of use by the consumer. It is also desirable that the package enable the consumer to remove product therefrom as simply as possible. Furthermore, the package should be easy to lift and carry, thereby making it desirable in many instances for the package to include a handle.

Perhaps most importantly, it is desirable, particularly in today's competitive marketplace, to reduce the costs associated with packaging. These costs, of course, include the costs of the materials required to make the package, the costs of making the package, shipping the empty package to the granular product manufacturer, forming and filling the package at the product manufacturer, shipping the filled package to the retailer, and all handling costs along the way.

Combining all of these features into one package for housing granular materials is not an easy task. Particularly troubling is the inclusion of a handle on a package while maintaining costs at a minimum. Handles often increase costs significantly. Sometimes the handles themselves or their attaching elements are expensive and sometimes the method of attachment is costly. Handles, also, often create irregularly shaped blanks and containers which occupy excessive space increasing shipping and handling costs.

Attachment of handles to various types of containers is not new. U.S. Pat. No. 4,176,423 issued to Wigemark on Dec. 4, 1979 and U.S. Pat. No. 3,604,052 issued to Bringer on Sept. 14, 1971 are exemplary of handles attached to containers by inserting their ends into openings in the container. There is, however, nothing to prevent granular material from flowing out through the openings with this type of arrangement.

U.S. Pat. No. 4,344,534 issued to Sutton on Aug. 17, 1982 and U.S. Pat. No. 4,516,687 issued to Taguchi et al on May 14, 1985 are exemplary of typical package handles attached externally to containers. These handles are attached to the container by the use of an externally mounted fitment. The fitment is generally a "U" shaped attachment and the handle fits through the space in the "U". Although this arrangement effectively prevents the escape of granular materials since there is no opening in the container, this arrangement results in increased packaging costs due to the irregularly shaped container caused by the external fitments.

U.S. Pat. No. 4,986,420, to Gunn et al, discloses a package with a strap handle which avoids the prior handles which were inserted into the openings of the container and the need for externally attached fitments which resulted in increase packaging costs. The handle of the patent includes barbs at each end which are fitted into apertures in the side walls of the container. The package also includes an insert so that granular material does not flow out of the package. The barb members on each end of the strap handle are adapted to hook into the respective apertures without permitting the handle to pull completely out during normal use. While being disclosed as a handle which minimizes packaging costs, the process for inserting the barbed strap handles into the apertures requires specialized machinery and, accordingly, the manufacture and use of such machinery adds to the production costs of the package.

Recently, strap handles have been used on packages which contain granular material such as detergents in which the strap handle is attached to the top of the package. Such packages, in particular, those packages used to hold a granular detergent material include a flip-top in which the top is attached to the body of the container by means of a hinge at the rear of the package and to the remaining package sides by an intermediate tear strip which extends around three sides of the package. The tear strip is torn away by the consumer allowing the top to flip up and close along the rear hinge. Unfortunately, once the tear strip is removed, the handle cannot readily be used again since the top simply flips up upon lifting of the handle. Such a handle is not very convenient as the consumer cannot carry the package from one location to another once the tear strip has been removed. The invention is not limited to only those packages which contain granular products, but to packages with handles, in general, regardless of the contents of the package.

Accordingly, it is an object of the present invention to provide a handle for a package which is suitable for housing granular materials.

Another object of the present invention is to provide a package which includes a handle and is strong enough to withstand the rigors of transportation from the manufacturer to the consumer, and is convenient for the consumer to transport and remove the contents therefrom.

Still another object of the invention is to provide a handle for a package and which can be attached to the package in a manner which allows the consumer to readily transport the package from one location to another both before and after the top lid of the package has been opened.

A further object of the present invention is to provide a package with a strong and convenient handle while maintaining all packaging associated costs to a minimum.

Yet another object of the invention is to manufacture a package which contains a handle and to maintain all manufacturing costs for such package to a minimum.

SUMMARY OF THE INVENTION

In accordance with the present invention, there is provided a package which contains a novel strap handle attached to the outer side walls of the package. The strap handle is made of a thin film or sheet of flexible material including plastic and includes a longitudinal slit of sufficient length to divide the handle into two portions, a lower attachment portion which is secured to the side walls of the package and a free upper ribbon which can be grabbed by the user and pulled away from the sides of the package and lifted over the top thereof for transporting the package from one location to another. The strap handle may contain tear resistant hinges at the respective ends of the slit to allow movement of the upper free ribbon relative to the attachment portion as above described for transport of the package without tearing the strap handle. Alternative straps handles are disclosed which provide either an extended amount of the attachment portion to secure the handle to a package or a smaller amount of the attachment portion to provide an unobstructed view of indicia placed on the sidewall of the package.

The package containing the strap handle of the present invention is remarkably easy to manufacture. Thus, a continuous feed of handles can be glued with a pressure sensitive adhesive on the lower attachment portion and secured to carton blanks also fed on a continuous basis. At the contact point between the handle and carton blank, pressure can be applied to secure the adhesive bonded side of the strap handle to the carton blank. Readily available equipment can be utilized to glue the strap handle to the carton blank, and readily available carton blanks can be used substantially minimizing the cost of the manufacture of the whole package.

DESCRIPTION OF THE PREFERRED EMBODIMENTS

Figure 1:
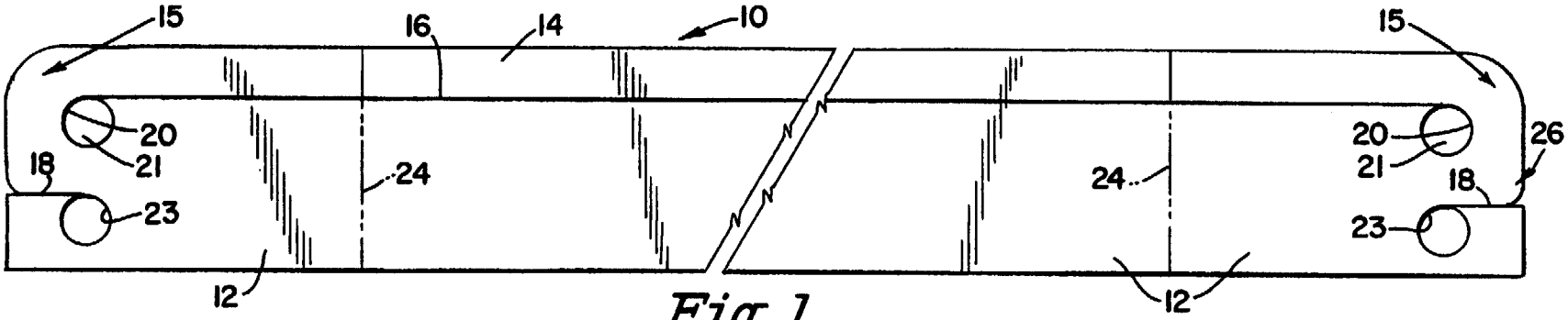
FIG. 1 is a plan view of the flexible strap handle of the present invention.

Referring to FIG. 1, reference numeral 10 designates the flexible strap handle of the present invention of generally rectangular shape, although such shape is not believed to be critical to the usefulness of the invention. Extending along the length of strap handle 10 is a slit or cut 16 which extends wholly through the thickness of handle 10 and is sufficiently long to divide handle 10 into two portions, a lower body or attachment portion 12 which can be secured to any or all of the side walls of a package and an upper free handle portion or ribbon 14 which is not secured to the package but which can be pulled away from the package and lifted over the top thereof for placement in the transporting or carrying position. Although ribbon 14 is freely movable with respect to the attachment portion 12 of handle 10, the strap handle 10 is formed from one piece of a flexible material. Preferably handle 10 is formed of a thin film or sheet of flexible plastic material having a thickness ranging from about 3 to 50 mils. Any suitable thermoplastic or thermosetting resin, laminate or composite thereof can be used to form the handle 10 of the present invention as long as the plastic can be formed into thin films or sheets of the requisite thickness and have sufficient flexibility and strength including a high tear resistance and a high tensile strength. Non-limiting examples of useful resins include polyesters, polyolefins, polyvinylhalides, polystyrene, polycarbonates, polyamides, polyurethanes, etc. Filled resins, blends of two or more resins, co-extended or structural laminates of two or more resins, or composites of dissimilar materials, e.g., laminate of plastic and paper can be used to form the strap handle of this invention. There is no intention to limit the invention to any particular plastic material, the only requirement being that the plastic material be sufficiently flexible and strong to resist tearing while in the transporting or carrying position. Preferred examples of plastics which may be particularly useful include amorphous polyethylene terephthalate, polyvinylchloride, polyethylene, polypropylene or polyethylene/polypropylene copolymer.

Figure 2:
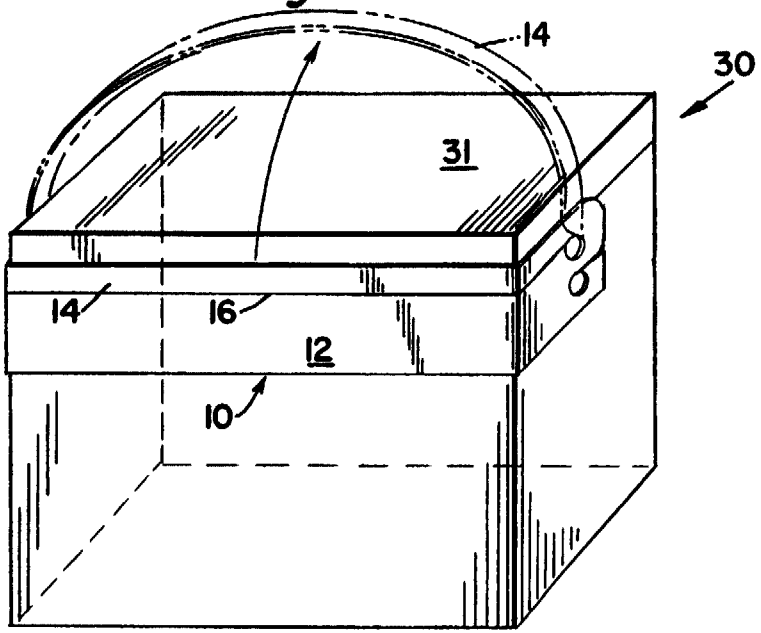
FIG. 2 is a isometric view of a typical flip-top package with the flexible strap handle attached; the handle in the transporting position being shown in phantom lines.
Figure 3:
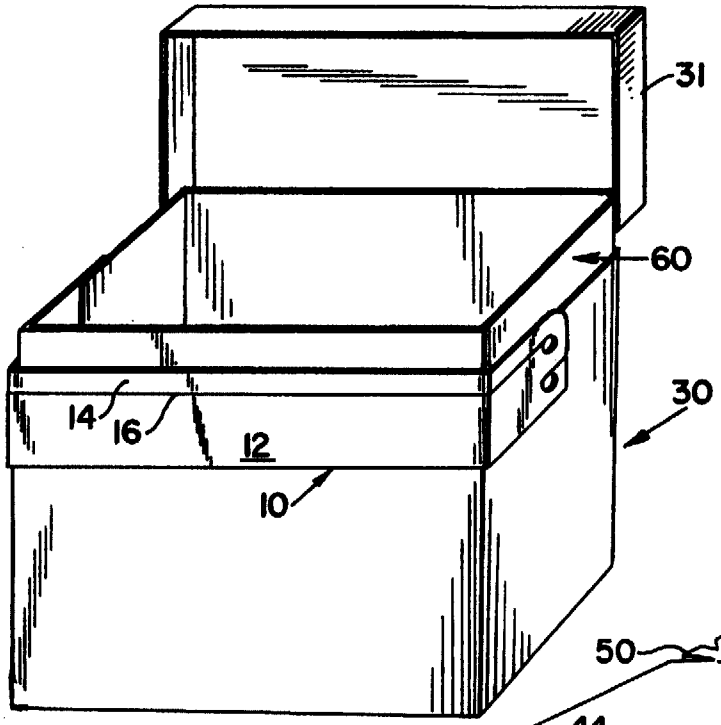
FIG. 3 is a perspective view of the package of FIG. 2 with the strap handle out of the way and the package opened.

Referring to FIGS. 2 and 3, in a particularly preferred embodiment, the present invention provides a package, indicated generally as 30, containing a flip top lid 31 and the strap handle 10 of the present invention. The package shown is particularly adapted for housing granular materials but it is to be understood that the contents of the package do not form a part of the invention and it is contemplated that the strap handle of this invention can be used on a myriad of package types. FIG. 2 illustrates a typical flip-top package 30 containing a strap handle 10 of the present invention wherein ribbon 14 is in the position of storage and for transport when lid 31 is closed and FIG. 3 shows package 30 containing strap handle 10 and the placement of ribbon 14 when lid 31 is opened. Handle 10 is preferably produced from a plastic which can be formed into transparent sheets or films. A transparent handle is particularly useful since there would be no need to rearrange the printing of packages at present and such materials would allow the unencumbered display of commercial logos and trademarks.

Figure 6:
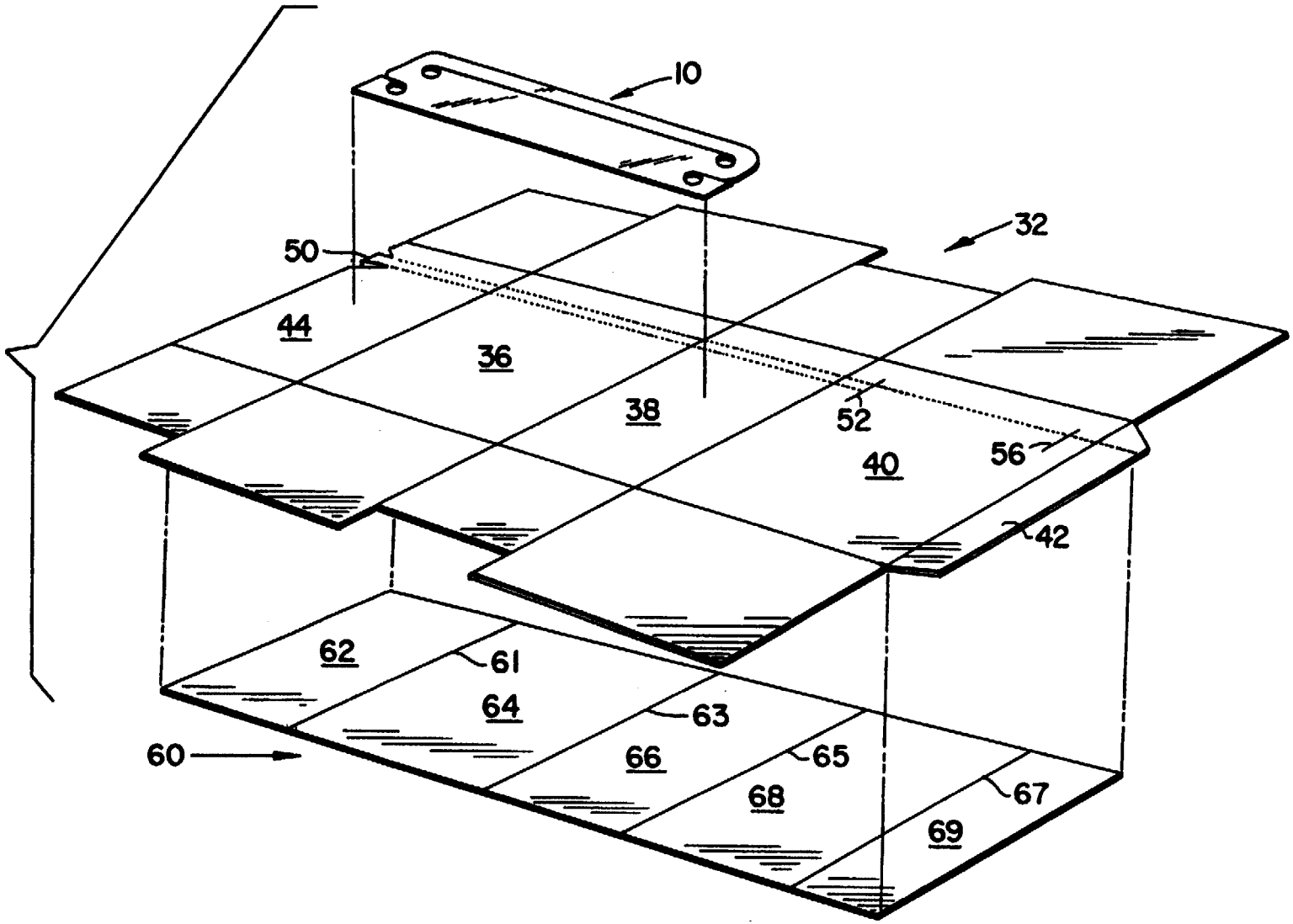
FIG. 6 is an exploded view illustrating the combination of a package blank, the flexible strap handle of the present invention and a liner typically used in packages which contain granular materials.

As seen in FIG. 6, a typical package 30 such as used to hold granular material, in particular, a powdered detergent is assembled of several components. Among these components are an outer body blank 32, a liner 60 and the handle 10.

Figure 5:
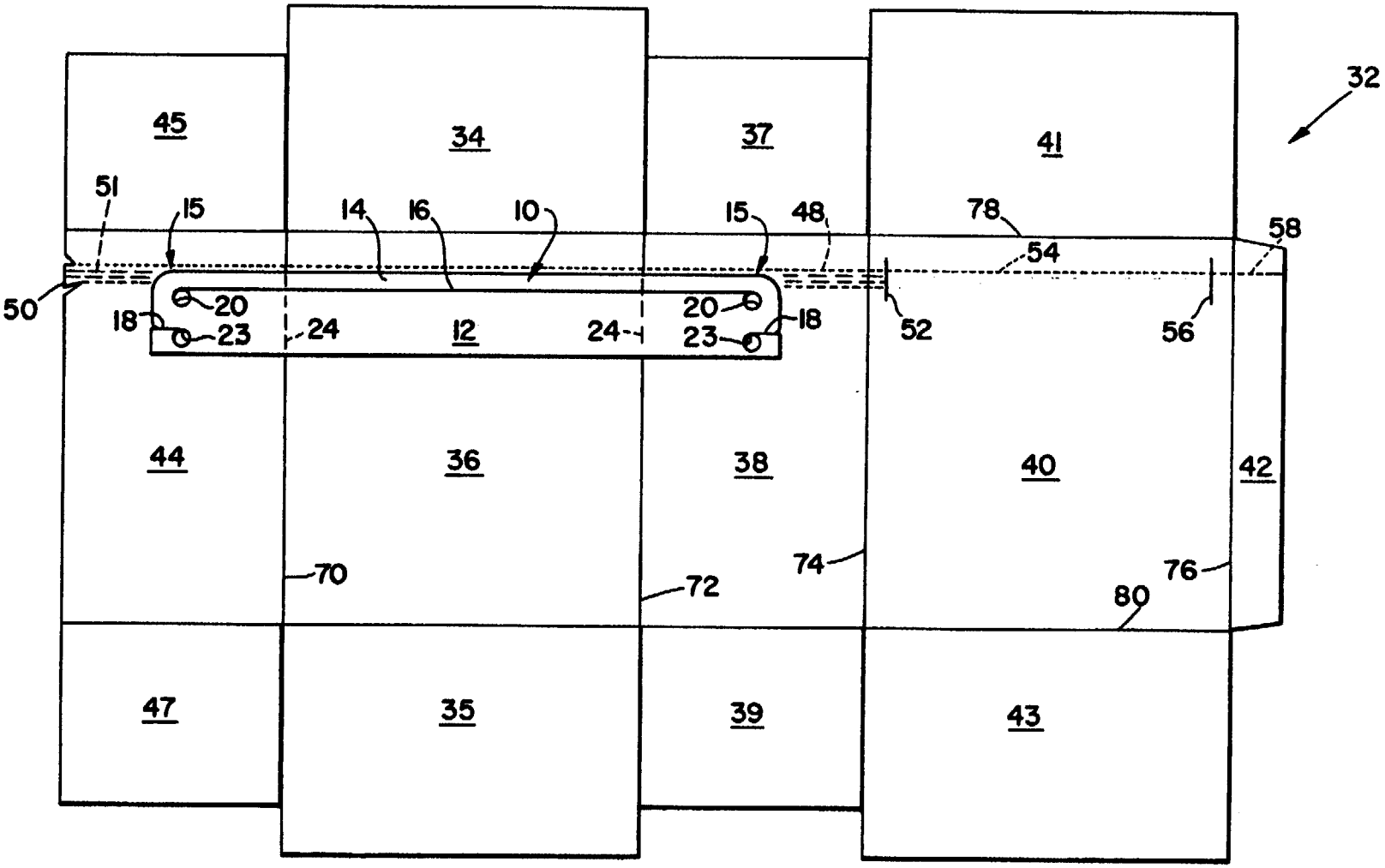
FIG. 5 is a plan view of a typical package blank which contains the flexible strap handle of the present invention attached thereto.

Referring now to FIG. 5, the outer body blank 32 is made of carton board, although other materials having similar properties can be used. The outer body blank 32 is conventional, per se, and represents a typical carton blank which can be used with the handle 10 of the invention. The present invention, however, is not to be limited to the particular blank illustrated. Outer body blank 32 has four axial score lines 70, 72, 74, and 76 and two transverse score lines 78 and 80. The side wall of the package is formed of four segments 44, 36, 38 and 40 (first through fourth, respectively) located between the transverse score lines 78 and 80. Four flaps 45, 34, 37 and 41 are hingedly attached at score line 78 which, upon assembly, combine to make the top wall of the package 30. Similarly, four flaps 47, 35, 39 and 43 are hingedly attached at score line 80 which, upon assembly, combine to make the bottom wall. A glue seam flap 42 is hingedly attached along axial score line 76.

A tear strip 48 is scored into the side wall near the top transverse score line 78. The score line of the tear strip 48 is a series of spaced parallel continuous cuts in the outer surface of the carton board which extend partially through the thickness of the carton board. The tear strip 48 originates at the exposed axial edge of the first side wall segment 44. At the origin of the tear strip 48, the side wall segment is notched and the tear strip 48 is enlarged to create a tab 50 to make grasping the tear strip 48 easier. The tear strip 48 terminates at a cut 52 extending through the carton board which is perpendicular to the tear strip 48 in the fourth side wall segment 40. A nylon tape 51 is preferably aligned with and attached to the tear strip 48 on the inside surface of outer body 32 to reinforce the tear strip.

The fourth side wall segment 40 has a single hinge line 54 scored into it and aligned with the upper score line of the tear strip 48. The score of the hinge line 54 is a perforated line. The hinge line 54 begins at the perpendicular cut 52 terminating the tear strip 48 and ends at a second perpendicular cut 56. Beyond the second perpendicular cut 56 is a perforated line 58 aligned with the hinge line 54 which is perforated through the remainder of the fourth side wall segment 40 and the glue seam flap 42 to allow the part above the perforation to become part of the lid 31 of the package 30.

Strap handle 10 is attached to the outer body blank 32 by gluing the lower attachment portion 12 and securing the strap handle 10 to side wall segments 44, 36 and 38. In the configuration shown in FIG. 5, the strap handle would be positioned at the front of the carton 30 such as shown in FIGS. 2 and 3. Inasmuch as the specific type of outer body blank is not critical to the invention, a slightly different configuration of the carton blank may afford the ability to position strap handle 10 on those side wall segments which would place the strap handle at the rear of the formed container. Inasmuch as it is necessary to lift the upper ribbon 14 over the top of the container, it is preferred to adhere strap handle 10 on the outer body blank 32 as close as possible to the sections of the outer body blank 32 which form the top of the formed carton. It is important, however, that if a tear strip such as illustrated tear strip 48 is used to open the carton, slit 16 of strap handle 10 must be positioned below the score lines for the tear strip.

Figure 7:
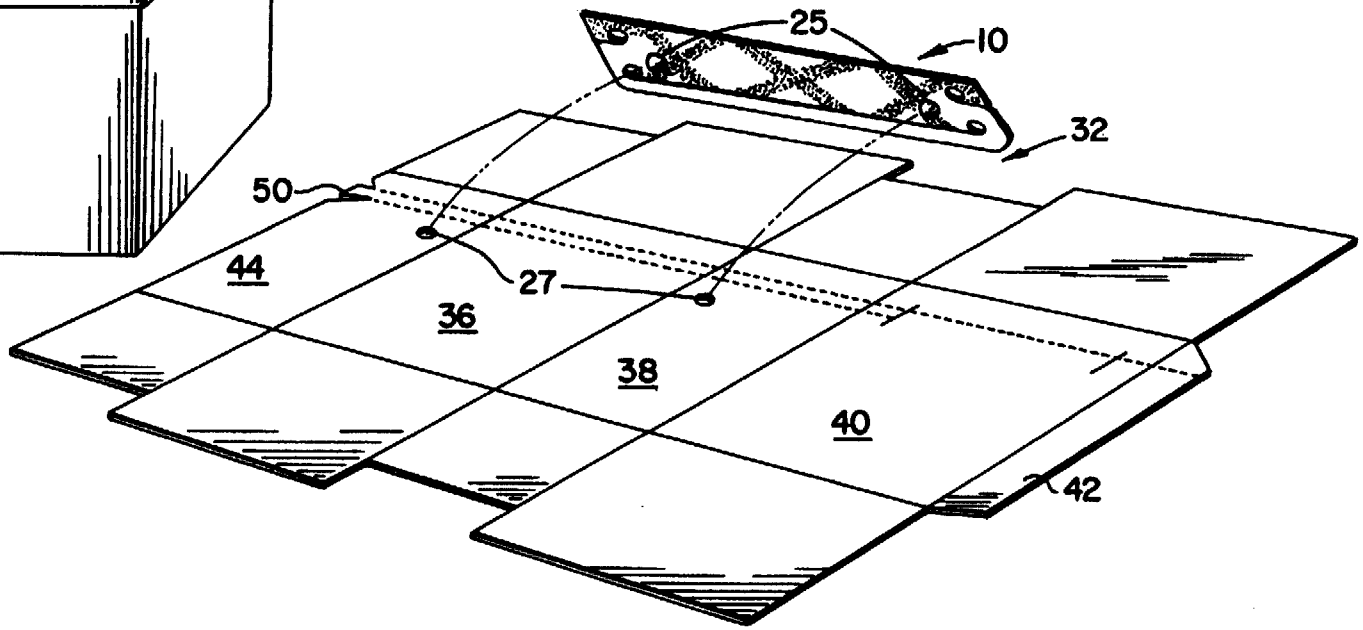
FIG. 7 is an exploded view illustrating the combination of a package blank and an alternative flexible strap handle of the present invention which contains dimples for firmly securing the strap handle to the carton.

If a relatively thick film of flexible material is needed to form strap handle 10 so as to support a heavier container, it is preferred to provide handle 10 with two transverse score lines 24 located an axial distance from each other which is approximately equal to the width of the large side wall segments of the outer body blank 32. Further, while it is preferred to provide strap handle 10 as a thin film or sheet which is essentially flat, an alternative strap handle may include projections molded within the plastic film or sheet to ensure securing of the strap handle 10 to the carton blank. Such an alternative is shown in FIG. 7 in which strap handle 10 includes spaced projections 25 molded as one piece with the strap handle 10 and placed at the respective ends of strap handle 10 for insertion into apertures 27 provided in opposite side wall segments 44 and 38. The projections 25 may be less spaced apart and inserted within apertures placed in sidewall segment 36. It is believed that upon securing the projections 25 of strap handle 10 into apertures 27, such as by gluing, the strap handle can be more securely attached to the outer body blank and ultimately the container once filled with its contents. The apertures 27 are positioned near the tear strip 48 in the desired side wall segments. There must be a sufficient distance between the apertures 27 and the tear strip 48 so that the side wall of the package 30 does not tear out when a full package is carried by the handle 10.

Again, referring to FIG. 6, a liner 60 is usually attached to the outer body 32 blank especially if the container is to hold a granular material. Attachment is provided by applying glue to the outer body 32 blank. The paper board liner 60 has five segments 62, 64, 66, 68 and 69 separated by four axial score lines 61, 63, 65 and 67. The score lines 61, 63, 65 and 67 are typically perforated lines. Each of the three middle segments 64, 66 and 68 are only slightly smaller than corresponding side wall segments 36, 38 and 40 of the outer body blank 32. The remaining two segments 62 and 69 combine to become slightly smaller than the remaining side wall segment 44 of the outer body blank 32. The dimensions of the liner side wall segments 62, 64, 66, 68 and 69 are smaller than the dimensions of the outer body side wall segments 44, 36, 38 and 40 so the liner 60 fits snugly inside the outer body blank 32 when the package 30 is formed.

Once attached, the outer body blank 32 and liner 60 are then folded along their score lines 74 and 67, respectively. Glue is placed along the outer body 32 glue seam flap 42 and the liner 60 side wall segment 69. Next, the outer body blank 32 and liner 60 are folded along their score lines 70 and 61, respectively, which results in the liner 60 being glued to itself and the outer body blank 32 being glued to itself creating a sleeve. This also causes the handle 10 to bend at one of its score lines 24 if present. The handle 10 is flat against this sleeve. In this relatively flat position, the package 30 can then be bundled and shipped to the manufacturer of granular material. Upon receipt by the manufacturer of granular material, the package 30 is assembled and filled as with any other standard carton using standard machinery.

Referring to FIG. 2, the result is an assembled package 30 filled with granular material. The package 30 has a top 31, a bottom wall and a side wall. The side wall connects the top to the bottom wall to form an enclosure.

If the alternative strap handle 10 as shown in FIG. 7 is used, the side wall of the outer body blank 32 will contain two spaced apertures 27. The liner 60 is located adjacent the apertures 27, separating the contents of the package 30 from the area immediately surrounding the apertures 27 and preventing the leakage of the contents.

To transport the package 30 from the retailer, the consumer grasps the upper ribbon 14, pulls it away from the side of the package 30 and lifts it over the top to a carrying position over the enclosure, as seen in FIG. 2. The consumer then transports the package 30 with the aid of the ribbon 14 to the ultimate place of use of the product.

To reach the contents of the package, the package 30 must be opened. To open the package 30, the consumer grasps ribbon 14 and pulls downwardly such that ribbon 14 is placed away from the tear strip 48 if necessary and then grasps the grasping tab 50 of the tear strip 48 and removes the tear strip 48. The tear strip 48 is assured of not tearing through the fourth side wall segment 40 of the package 30 by the perpendicular cut 52. The consumer then rotates the lid 31 which is connected to the side wall by the hinge line 54 to the open position as shown in FIG. 3. The liner 60 of the preferred embodiment sticks up past the outer body 32 once the tear strip 48 is removed. This provides a structure for the lid 31 to rest upon in the closed position.

Figure 4:
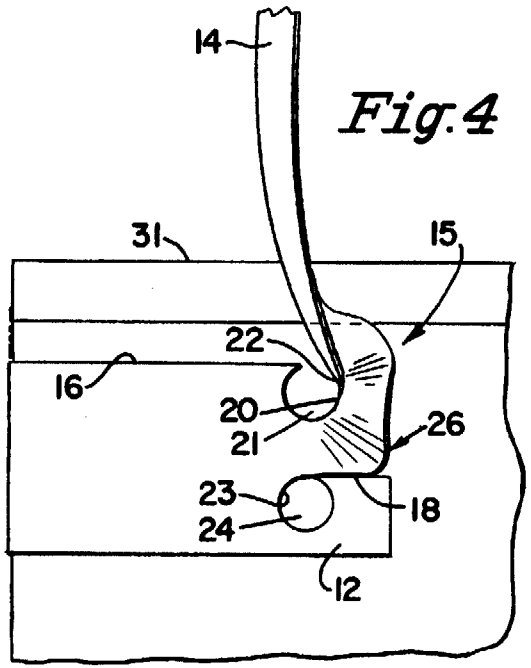
FIG. 4 is a fragmentary side elevation of the package containing the strap handle of the present invention, illustrating the hinge of the flexible strap handle with the upper free ribbon lifted in the transporting position.

As ribbon 14 of strap handle 10 is pulled away from the side of the carton and lifted over the top thereof, there are formed various stresses on the strap handle. For one, stress is formed at a location approximate the respective ends of slit 16. In most plastics, such stress will result in a tearing of the handle 10 initiating at the respective ends of slit 16 and propagating into the surrounding body of handle 10 in the form of a generally irregular and unaesthetic tear which can greatly reduce the strength of handle 10 and eventually destroy the ability of handle 10 to be used in the transporting position. Accordingly, in a preferred embodiment of the invention, handle 10 is provided with what can be characterized as a hinge on both ends of slit 16 to relieve the stresses when the ribbon 14 is in the carrying position and to prevent the initiation and propagation of tears into the body of handle 10. Referring to FIGS. 1 and 4, a hinge 15 is provided in the strap handle 10 at each end of handle 10 approximate the ends of slit 16. To create hinge 15 and eliminate the propagation of a tear in handle 10 initiating at the end of slit 16, a cut or slit 20 continuous with the end of slit 16 is provided and which is continued in a downwardly direction from the end of slit 16. As shown in FIGS. 1 and 4, the slit 20 can be continued to form a complete circle and yield a cut-out portion 21 at the respective ends of slit 16. The slit 20 relieves the stress which is provided at point 22 shown in FIG. 4 as ribbon 14 is lifted up over the top of the container and the handle 10 is used to carry the container. Slit 20 creates a hinge 15 allowing ribbon 14 to move easier with respect to lower attachment portion 12 of handle 10. Further, without the downwardly directed slit 20 a tear would initiate at the end of slit 16 and non-uniformly propagate into the body of handle 10 greatly weakening the handle 10 at the point where ribbon 14 is connected to body 12.

For the convenient use of strap handle 10, it is important that the consumer be able to readily pull ribbon 14 away from the side of the carton and over the top surface of the container and at the same time, it is important that the integrity of the handle 10 be maintained such that no tears which can weaken the handle are initiated and propagated. As ribbon 14 is lifted over the top of a container and grasped to carry the container, there are additional stresses placed on each end of attachment portion 12 of handle 10 approximately at mid-width of portion 12 and which can initiate tears and, importantly, tend to inhibit the movement of ribbon 14 over the top of the container. Accordingly, in another preferred embodiment of the invention, a slit 18 is provided between slit 16 and the bottom of handle 10 and extending from the respective ends of handle 10 inward to the approximate location where slit 16 ends. The slit 18 creates a hinge 26 which greatly improves the movement of ribbon 14 with respect to the attachment portion 12 and allows ribbon 14 to be readily moved over the top of the container on which handle 10 is attached. Slit 18 is provided at a location approximately ⅓ of the distance up from the bottom of handle 10 along the width thereof. This location appears to best relieve the stresses formed in handle 10 as the ribbon 14 is lifted over the top of the container and carried. Also, the location provides ribbon 14 with a sufficient amount of free movement at hinges 15 and 26 and provides handle 10 with sufficient strength that no breakage of ribbon 14 from the remaining body portion of handle 10 occurs. To prevent tear initiation and propagation from the end of slit 18, a downwardly formed slit 23 initiating at the end of slit 18 can be provided. As shown in FIGS. 1 and 4, slit 23 can be extended full circle to form a hole 24. It is important to note that the formation of holes 21 and 24 does not appear to be critical to the formation of hinges 15 and 26 and that slits 20 and 23 provided to eliminate tear initiation and propagation along slits 16 and 18, respectively, can simply be spiral cuts which do not come full circle. While slit 18 is shown in the preferred position, there can be some variation of the location where slit 18 is formed. Thus, the location of slit 18 may vary from plastic to plastic depending upon the particular flexibility and strength thereof. However, a slit 18 which is too close to slit 16 may not provide the advantage of additional free movement of ribbon 14 while at the same time, a slit 18 which is too close to the bottom of handle 10 may result in tear initiation and propagation in the handle 10 thus weakening the handle.

Figure 8:
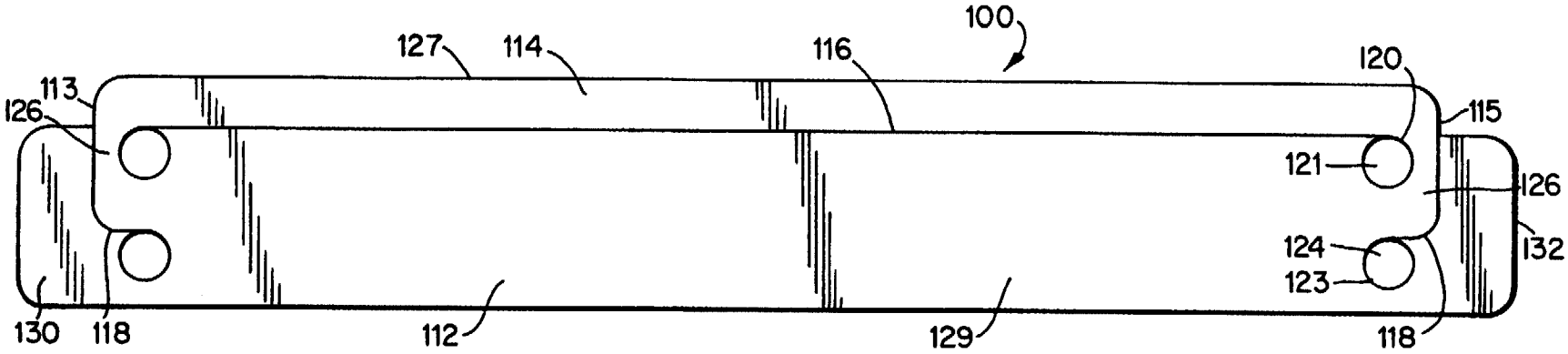
FIG. 8 is a plan view of an alternative strap handle.
Figure 9:
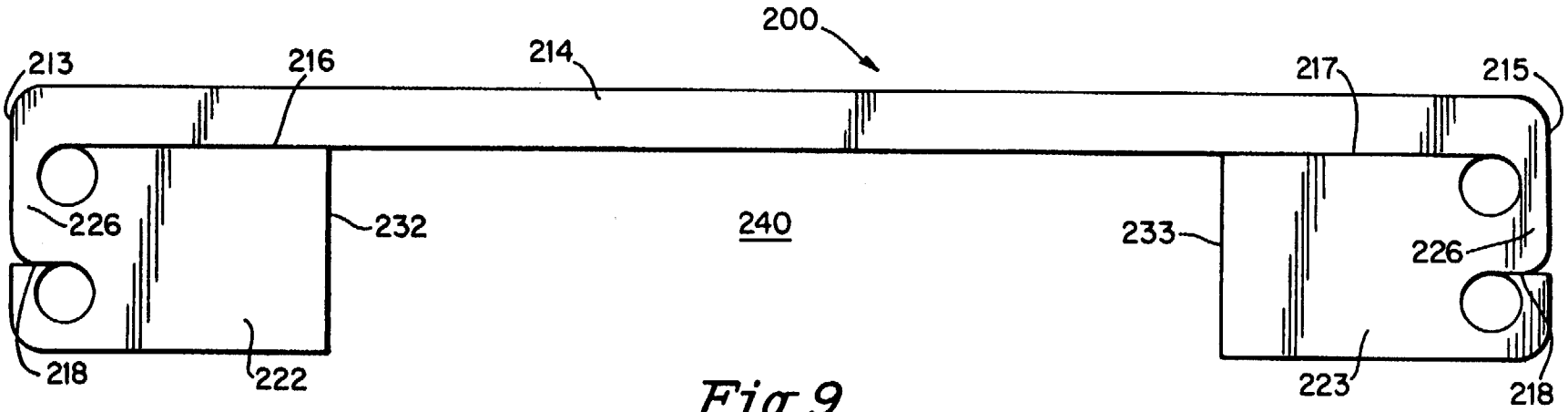
FIG. 9 is a plan view of an alternative strap handle.

FIGS. 8 and 9 illustrate alternative strap handles 100 and 200, respectively, which vary between each other and strap handle 10 as shown in FIG. 1 with respect to the attachment portion of the strap handle. Strap handle 100 as shown in FIG. 8 is essentially equivalent to strap handle 10 as shown in FIG. 1 containing a slit 116 extending along the length of the strap handle. The ends of slit 116 are spaced from ends 113 and 115 of strap handle 100. Slit 116 divides strap handle 100 into two portions, a lower body portion or attachment portion 112 which can be secured to any or all of the sidewalls of a package and a free handle portion or ribbon 114 which is not secured to the package but which can be pulled away from the package and lifted over the top thereof for placement in the transporting or carrying position as equivalent to strap handle 10. Respective hinges 126 placed on opposite ends of the strap handle 100 are formed by a pair of respective slits 118 which extend from respective ends 113 and 115 of strap handle 100 and extends inward approximately to the respective ends of slit 116. A pair of respective slits 120 and 123 can extend from the ends of slits 116 and 118, respectively, in a downward direction so as to relieve the stress and reduce if not eliminate tear propagation at the ends of respective slits 116 and 118. As shown in FIG. 8, slits 120 and 123 can be continued to form a complete circle and yield respective cutout portions 121 and 124.

The difference between handle 100 as shown in FIG. 8 and handle 10 as shown in FIG. 1 is that handle 100 includes additional attachment portions which can be secured to the sidewalls of a package. Strap handle 100 is particularly useful as a handle for a package which contains heavier components so as to insure that handle 100 can be maintained on the sidewalls of a package during the transporting position as shown by the broken line ribbon 14 in FIG. 2. Thus, strap handle 100 includes attachment wings 130 and 132 which extend both longitudinally from the respective ends 113 and 115 of handle 100 and transversely in the direction of top edge 127 from the bottom edge 129 of handle 100 beyond respective slits 118. Wings 130 and 132 are continuous with attachment portion 112 and along with the attachment portion 112, are glued or otherwise secured to the sidewalls of a package. Hinges 126 on respective opposite sides of handle 100 are still free to bend to improve the movement of ribbon 114 with respect to attached portion 112. Wings 130 and 132 are provided to extend the attachment portion of handle 120 so as to insure the attachment of strap handle 100 to the package.

On the other hand, if the package to be transported is relatively light, the attachment portion of the strap handle does not need to be as extensive as the attachment portion of handle 100 in FIG. 8 or even handle 10 in FIG. 1. Handle 200 as shown in FIG. 9 is useful either to carry relatively light packages or to insure that any product identification on the sidewall of the package is not obstructed by the placement of handle 200. Handle 200 is essentially identical to handle 10 of FIG. 1 except that a portion of the attachment portion of the handle is removed. Thus, handle 200 includes a ribbon portion 214 and respective attachment portions 222 and 223 which are spaced from each other. Slit 216 extends from inner wall 232 of attachment portion 222 toward end 213 of strap handle 200 and is spaced from such end to divide attachment portion 222 from ribbon 214. Likewise, slit 217 extends from inner wall 233 of attachment portion 223 toward outer end 215 of handle 200 and is spaced from such end so as to divide attachment portion 223 from ribbon 214. Slits 218 extending from respective ends 213 and 215 toward the center of the strap handle form respective hinges 226 on opposite ends of strap handle 200 equivalent to that formed in ribbon 10 as shown in FIG. 1. When placed on the sidewall of a package, the space 240 between inner walls 232 and 233 of handle 200 allow any indicia or other package identification to be clearly seen unobstructed by handle 200. It is also possible to combine the embodiments shown in FIGS. 8 and 9 by including the attachment wings 130 and 132 to strap handle 200. By such combination, a greater amount of attachment portion is added to the handle 200 and at the same time, package indicia will remain unobstructed at the center of the package sidewall on which the handle is attached.

As can be seen from the above description, the strap handles 10, 100 or 200 are easily manufactured, requiring only conventional molding and, if necessary, cutting or scoring equipment. Unlike U.S. Pat. No. 4,986,420, no specialized equipment is needed to attach the strap handle to the outer body of a carton blank and no specialized blank is required such as that needed for the attachment of exterior fitments and the like. Consequently, a strong and convenient handle is provided for containers, in general. The handle can accommodate any type of container, in particular, the popularly used flip-top containers which utilize a tear strip to open the container.

While particular embodiments of the present inventions have been shown and described, modification may be made to the handle or package without departing from the teachings of the present invention. Accordingly, the present invention comprises all embodiments within the scope of the appended claims.

What is claimed is:

1. A strap handle capable of being attached to and used to transport a package having a sidewall and a top, comprising: a unitary piece of flexible material in the form of a strap having top and bottom edges and first and second outer ends, a first longitudinal slit in said strap having a first end spaced from said first outer end and a second end spaced from said second outer end, said slit having a sufficient length to divide said strap into a lower attachment portion which is capable of being secured to the sidewall of the package and a free upper ribbon which is capable of being pulled away from the sidewall and lifted over the top of the package for transport, said strap handle further including a second slit located intermediate said first longitudinal slit and said bottom edge of said strap and extending longitudinally from said first outer end of said strap, a first hinge located between said top edge of said strap and said second slit and in the space between said first outer end of said strap and said first end of said first longitudinal slit, a third slit located intermediate said first longitudinal slit and the bottom edge of said strap and extending longitudinally from said second outer end of said strap, a second hinge located between the top edge of said strap and said third slit and in the space between said second outer end of said strap and second end of said first longitudinal slit, said first and second hinges providing improved movement of said free upper ribbon relative to said lower attachment portion and, first and second attachment wings continuous with said lower attachment portion and extending longitudinally from said first and second outer ends, respectively, a portion of each of said wings extending transversely from said bottom edge in the direction of said top edge and said portion of each of said wings being separated from said first and second outer ends, respectively.

2. The strap handle of claim 1 wherein said flexible material comprises a plastic, a laminate of said plastic or a composite of said plastic.

3. The strap handle of claim 1 wherein said flexible material comprises a film or sheet of plastic, plastic laminate or plastic composite and having a thickness of from about 3 to about 50 mils.

4. The strap handle of claim 2 wherein said flexible material is transparent.

5. The strap handle of claim 3 wherein said film or sheet is transparent.

6. The strap handle of claim 1 wherein said first and second attachment wings extend transversely from said bottom edge toward said top edge to a location intermediate said top edge and said second and third slits, respectively.

7. The strap handle of claim 1 further including a fourth slit being located at and continuous with said first end of said first longitudinal slit, a fifth slit being located at and continuous with said second end of said first longitudinal slit, said fourth and fifth slits each extending in a downwardly direction so as to reduce tear initiation of said strap at said first and second ends of said first longitudinal slit.

8. The strap handle of claim 7 wherein said fourth and fifth slits are substantially circular slits.

9. The strap handle of claim 1 wherein said second and third slits extend longitudinally from the respective first and second outer ends of said strap for a length approximate the length of the respective space between said first and second outer ends of said strap and said first and second ends of said first longitudinal slit.

10. The strap handle of claim 1 including sixth and seventh slits being continuous with said second and third slits, respectively, and extending in a downwardly direction from said second and third slits so as to prevent tear initiation of the strap at the ends of said second and third slits, respectively.

11. A strap handle capable of being attached to and used to transport a package having a sidewall and a top, comprising: a unitary piece of flexible material in the form of a strap having top and bottom edges and first and second outer ends, a first longitudinal slit in said strap having a first end spaced from said first outer end and a second end spaced from said second outer end, said slit having a sufficient length to divide said strap into a lower attachment portion which is capable of being secured to the sidewall of the package and a free upper ribbon which is capable of being pulled away from the sidewall and lifted over the top of the package for transport, said lower attachment portion comprising first and second spaced portions contiguous with said first and second outer ends, respectively, said strap handle further including a second slit located intermediate said first longitudinal slit and said bottom edge of said strap and extending longitudinally from said first outer end of said strap, a first hinge located between said top edge of said strap and said second slit and in the space between said first outer end of said strap and said first end of said first longitudinal slit, a third slit located intermediate said first longitudinal slit and the bottom edge of said strap and extending longitudinally from said second outer end of said strap, a second hinge located between the top edge of said strap and said third slit and in the space between said second outer end of said strap and second end of said first longitudinal slit, said first and second hinges providing improved movement of said free upper ribbon relative to said lower attachment portion.

12. The strap handle of claim 11 wherein said flexible material comprises a plastic, a laminate of said plastic or a composite of said plastic.

13. The strap handle of claim 11 wherein said flexible material comprises a film or sheet of plastic, plastic laminate or plastic composite and having a thickness of from about 3 to about 50 mils.

14. The strap handle of claim 12 wherein said flexible material is transparent.

15. The strap handle of claim 13 wherein said film or sheet is transparent.

16. The strap handle of claim 11 further including first and second attachment wings continuous with said first and second spaced attachment portions, respectively, and extending longitudinally from said first and second outer ends, respectively, and transversely from said bottom edge in the direction of said top edge.

17. The strap handle of claim 16 wherein said first and second attachment wings extend transversely from said bottom edge toward said top edge to a location intermediate said top edge and said second and third slits, respectively.

18. The strap handle of claim 11 further including a fourth slit being located at and continuous with said first end of said first longitudinal slit, a fifth slit being located at and continuous with said second end of said first longitudinal slit, sixth and seventh slits being continuous with said second and third slits, respectively, said fourth, fifth, sixth and seventh slits each extending in a downwardly direction so as to reduce tear initiation of said strap at said first and second ends of said first longitudinal slit.

19. The strap handle of claim 18 wherein said fourth and fifth slits are substantially circular slits.

20. The strap handle of claim 11 wherein said second and third slits extend longitudinally from the respective first and second outer ends of said strap for a length approximate the length of the respective space between said first and second outer ends of said strap and said first and second ends of said first longitudinal slit.

* * * * *